United States Patent [19]

Grise

[11] Patent Number: 4,752,672

[45] Date of Patent: Jun. 21, 1988

[54] ELECTRICAL HEATING DEVICE

[75] Inventor: Frederick G. J. Grise, Osterville, Mass.

[73] Assignee: Flexwatt Corporation, Canton, Mass.

[21] Appl. No.: 945,841

[22] Filed: Dec. 23, 1986

Related U.S. Application Data

[63] Continuation of Ser. No. 580,472, Feb. 15, 1984.

[51] Int. Cl.[4] ..... H05B 3/16

[52] U.S. Cl. ..... 219/543; 219/345; 219/548; 219/552; 338/306; 338/314

[58] Field of Search ..... 219/211-213, 219/345, 522, 528, 543, 544, 548, 552; 338/308, 314, 320, 330, 333; 174/68.5

[56] References Cited

U.S. PATENT DOCUMENTS

| | | | |
|---|---|---|---|
| 2,277,772 | 3/1942 | Marick | 219/211 |
| 2,489,643 | 11/1949 | Hunter | 219/549 X |
| 4,485,297 | 11/1984 | Grise et al. | 219/528 |

FOREIGN PATENT DOCUMENTS

| | | |
|---|---|---|
| 629188 | 9/1949 | United Kingdom . |
| 1145367 | 3/1969 | United Kingdom . |

*Primary Examiner*—E. A. Goldberg
*Assistant Examiner*—M. N. Lateef
*Attorney, Agent, or Firm*—Hale and Dorr

[57] ABSTRACT

An electrical heating device comprises a substrate, a pair of parallel, spaced apart elongated conductors extending longitudinally of the substrate, and a semi-conductor pattern carried on the substrate and electrically connected to and extending between the conductors. The semi-conductor pattern produces a thermal image for an infrared target. In some embodiments, the thermal image is irregular or circular in shape and the semi-conductor pattern includes a plurality of transversely-spaced bars having relatively wide portions outside, and relatively thin portions within, the area producing the thermal image.

16 Claims, 4 Drawing Sheets

FIG 1
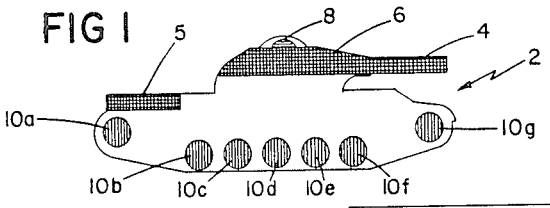
FIG 2
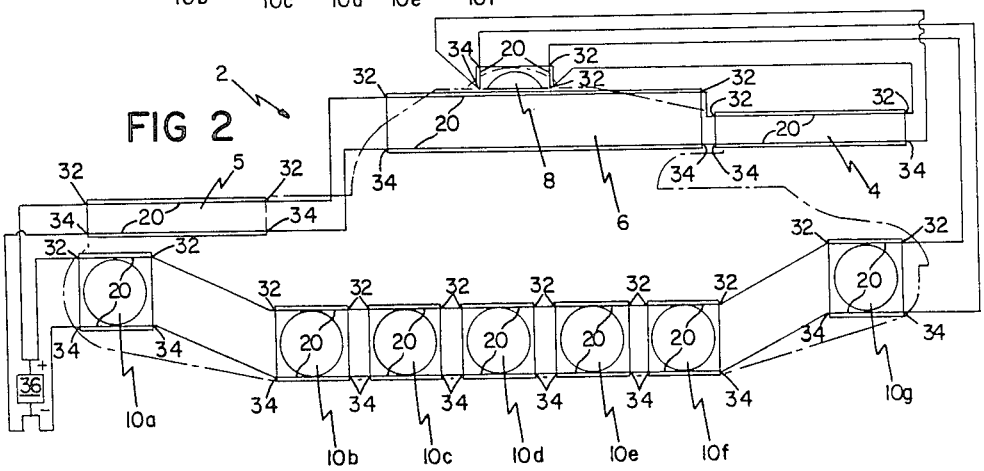
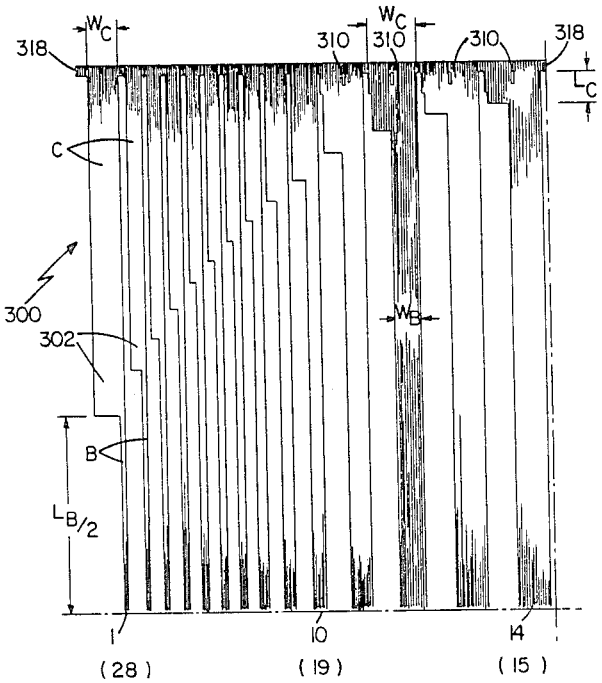
FIG 8
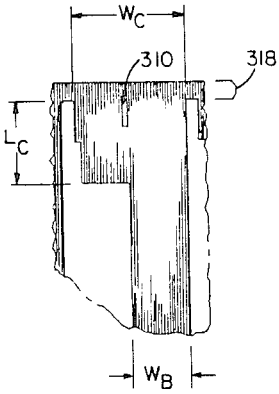
FIG 9

FIG 3
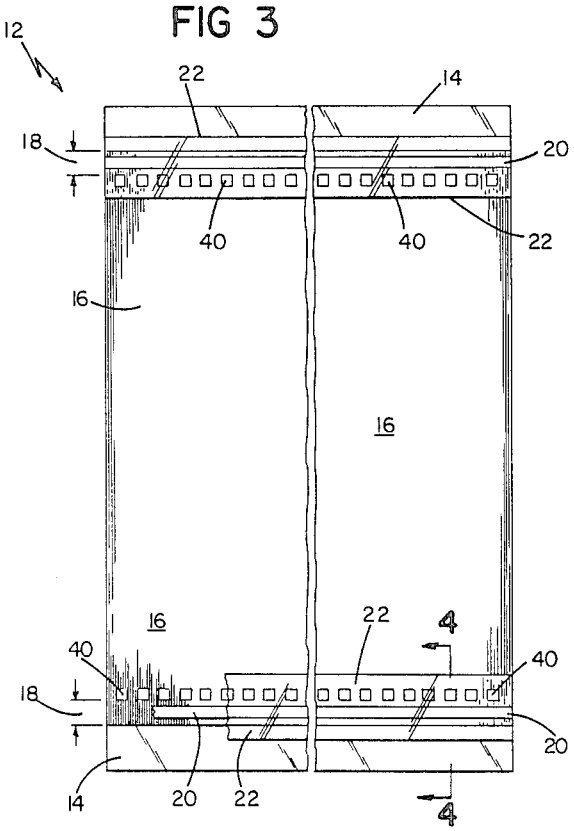
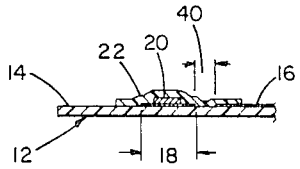
FIG 4
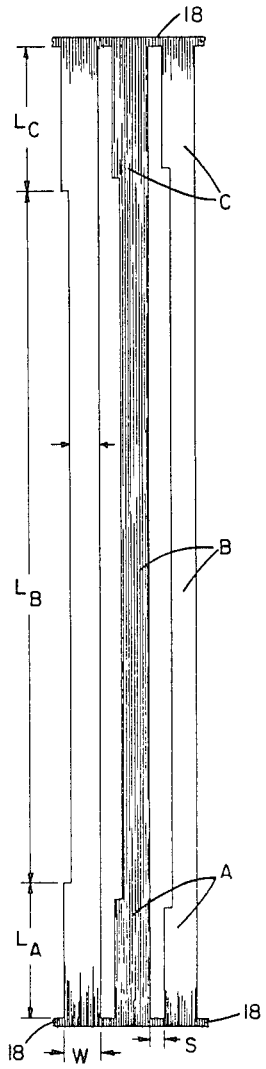
FIG 6

ELECTRICAL HEATING DEVICE

This is a continuation, of application Ser. No. 580,472, filed on Feb. 15, 1984.

This invention relates to electrical heating devices. More particularly, it relates to electrical sheet heaters having heated areas which are not parallel-sided quadrilaterals or portions of which have different watt densities.

BACKGROUND OF INVENTION

U.S. patent application Ser. Nos. 181,974, filed Aug. 28, 1980 and now abandoned, 295,400, filed Aug. 21, 1981, and 572,678, filed Jan. 20, 1984, all of which are now owned by the assignee of the present application and are here incorporated by reference, disclose flexible sheet heaters including a pair of longitudinally-extending (typically copper) conductors, and a semi-conductor pattern comprising a plurality of transversely-extending bars spaced apart from each other and extending generally between and electrically connected to the conductors. The heaters there disclosed provide superior performance and substantially even heat distribution, and are useful in a wide range of applications.

There are circumstances, however, in which constant heat distribution over a regular parallel-sided heated area is not desired. For example, targets used to produce thermal images which will be seen by an infrared sight should produce an irregular heat pattern which approximates the thermal image produced by the man, tank, or other target represented.

SUMMARY OF INVENTION

The present invention provides an electrical heater which produces a disparate or irregularly-shaped heat pattern and, in terms of cost, ease of installation and useful life, is particularly suited for use as an infrared imaging target.

In general, I have discovered that a sheet heater including a paper of plastic substrate, a pair of parallel, spaced-apart, longitudinally-extending conductors, and a semi-conductor pattern (typically of colloidal graphite) can be made to provide substantially a heated area having substantially any desired configuration if the semi-conductor pattern in the area extending between the conductors is constructed so that the resistivity (ohms/square), rather than being uniform, varies, the portion of the semiconductor pattern within the heated area being different that of the portions of the semi-conductor pattern outside the area.

DRAWINGS

FIGS. 1 and 2 are schematic views of an infrared target that forms a thermal image similar to that produced by a tank.

FIG. 3 is an enlarged view of a portion of the target of FIGS. 1 and 2.

FIG. 4 is a section taken at 4—4 of FIG. 3.

FIG. 6 is an illustrative view of portions of FIG. 5.

FIG. 8 is a plan view of a portion of the semi-conductor pattern used in a second target forming a circular thermal image.

DETAILED DESCRIPTION

Figure 5:
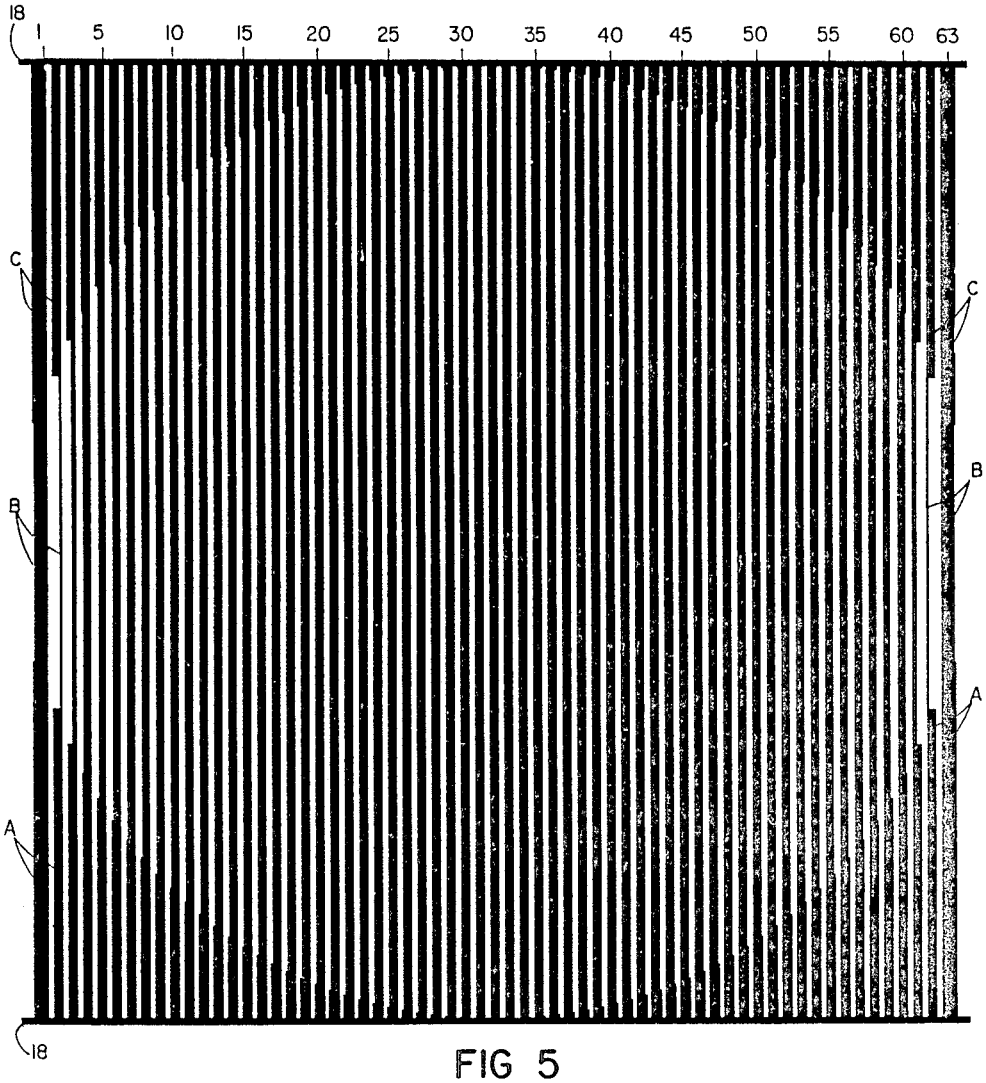
FIG. 5 is a plan view of a portion of the target of FIGS. 1 and 2.

Referring to FIGS. 1-6 there is shown an infrared imaging target, designed to produce a thermal image similar to that produced by a real tank. As shown, the target, generally designated 2, includes eleven heat-producing target portions, of varying size, shape and configuration mounted on a plywood support. Target portions 4 and 5 are generally rectangular and, as shown, are designed to form images corresponding, respectively, to the tank gun and engine. Target portion 6 is generally trapezoidal and forms an image corresponding to that of the tank turret. In practice, the sections of target portion 6 shown in dashed lines are folded back to produce a more accurate overall image. Target portion 8, in the shape of a circular segment, is positioned on top of target portion 6 and forms an image corresponding to that of the hatch on top of the turret. Finally, target portions 10*a* through 10*g* each form an image corresponding to one of the tank wheels.

Target portion 4 is shown in detail in FIG. 3. One of target portions 10 is shown in detail in FIG. 5.

As shown most clearly in FIGS. 3, 4 and 5, each of target portions 4, 6, 8 comprises a plastic substrate 12, on which a semi-conductor pattern 16 of colloidal graphite is printed. Substrate 12 is 0.003 inch think polyester ("Mylar"), corona discharge treated on the side thereof on which the semiconductor is to be printed. The semi-conductor pattern includes a pair of parallel longitudinal stripes 18, each 5/32 inch wide and spaced 24 inches apart. The area between stripes 18, except for a $\frac{3}{8}$ inch wide strip along the inside edge of each stripe, is coated with a dielectric, thermally-conductive non-glare solvent, carrier polyester material (obtained from Amicon Corp. of Lexington, Massachusetts). It should be noted that the dielectric coating affects the resistivity (ohms) space of the semi-conductor pattern, typically increasing it by about 42%. It will thus be seen that the resistivity of the coated portion of the semi-conductive pattern (e.g., 200 ohms/square) will be significantly more than that of the more conductive uncoated portion (e.g., about 140 ohms/square).

An electrode 20 comprising a pair of tinned copped strips each $\frac{1}{4}$ inch wide and 0.003 inch thick and placed one on top of the other as described in aforementioned application Ser. No. 572,678 is placed on top of each longitudinal stripe 18 with the bottom of the electrode engaging the underlying stripe 18. A narrow (about one inch wide) strip 22 of polyester tape with an acrylic adhesive coating (typically a "Mylar" tape obtained from either 3M Corp. of St. Paul, Minn. or Ideal Tape, Inc. of Lowell, Mass.) overlies each conductor 20 and holds it in tight face-to-face engagement with the underlying strip 18. Tape strip 22 is sealed to substrate 12 along the opposite longitudinally-extending edges of the respective conductor. As will be apparent, the tape strip 22 bonds both to the uncoated (i.e., semi-conductor free) area outside stripes 18 and to regularly-spaced uncoated areas along the inside edges of the stripes and conductors 20.

As shown in FIG. 2, both ends 32 of the conductor 20 along one side of each target portion are connected to the positive side of a 120 volt power source 36; both ends 34 of the conductor along the other side of the target portion are connected to the negative side of the power source. Power source 36 includes a single 12 volt battery connected to a connector to produce the desired 120 volt output.

Referring particularly to FIG. 3, it will be seen that the semi-conductor pattern of target portion 4 (and those or target portions 5 and 6 are in substantially identical) comprises a low resistance conductive graphite layer (resistance approximately 200 ohms per square) printed over essentially the entire area between stripes 18. The only areas not so covered are a series of small squares 40, each about ⅛ inch in height (measured parallel to stripes 18) and 3/16 inch in width (measured transverse to stripes 18) spaced along the inside edge of each stripe 18. The distance between adjacent squares 40 is ¼ inch. The tape strips 22 holding conductor pairs 20 in place bond to the semi-conductor free squares 40. It should be noted that, because squares 40 are within the area of the target that is not coated with the dielectric coating that covers most of the area between stripes 18, the semi-conductor material surrounding the squares 40 (and that forming stripes 18) is considerably more conductive than that in most of the area between stripes 18, thus eliminating "hot spots" that might otherwise be caused by the squares.

The semi-conductor patterns 12 of target portions 4, 5 and 6 produce essentially uniform heat over substantially the entire semi-conductor coated area between the longitudinal metal conductors 20. Such a heat pattern is, of course, usually desired in electrical heaters, and it is useful in target portions, such as target portions 4, 5 and 6, in which the desired thermal image is essentially rectangular or trapezoidal.

In some circumstances, however, it is desired to produce a thermal image that is not shaped like a parallel-sided quadrilateral, e.g., that is rounded or irregular in shape. For, among other reasons, ease of manufacture, it is desirable to be able to produce such shapes in heating devices which include, as do all of those described herein and in the aforementioned applications, essentially parallel metal conductors 20 located along the opposite sides of the heated area.

Referring to FIGS. 1 and 2, each target portion 10 produces a circular thermal (infrared) image, which represents a wheel. As with the other target portions of target 2, each target portion 10 includes a pair of spaced-apart, parallel metal conductors 20 extending the length of the substrate 12 on which the semi-conductor pattern forming the wheel target 10 is printed. The seven wheel targets 10*a*–10*g* are identical. The semi-conductor layer of each includes a repeat of the pattern shown in FIG. 5; and, as shown in FIGS. 5 and 6, comprises sixty-three transversely-spaced bars extending perpendicularly between spaced-apart parallel stripes 18, with an uncoated (i.e., a semi-conductor free) space between each pair of adjacent bars.

Since the stripes 18 and conductors 20 are parallel, all of the transversely-extending bars have the same overall length (24 inches in the wheel target embodiment shown). With the exception of the center-most bars (nos. 30–34), each bar of the semi-conductor pattern includes a pair of relatively wide (measured parallel to stripes 18) end portions A, C of equal length connected by relatively narrower center portion B. The lengths of the center portions B of the bars are such that the junctions between the center portions B and end portions A, C form, roughly, a circle representing the desired wheel, i.e., the center portions B lie within and the end portions A, C outside the perimeter of the wheel.

As explained in more detail hereinafter, the resistance of the center portions B of the bars (i.e., the portions within the circle) is effectively greater than that produced by the bar end portions (i.e., the portions outside the bounds of the circled). When power is applied to the conductors of target portion 10, the watt density of the areas within the perimeter of the circle of each wheel target will be substantially greater than that outside the circle's perimeters, and the areas within the perimeter of the circles thus will be heated to a higher temperature than will the areas outside. In the illustrated embodiment, when 120 volts is applied across the conductors 20 of target portion 8, the watt density of the area within the circle of each wheel target 10 will be about 12 watts per square foot and the temperature of the area will be raised to about 10 degrees F. above ambient. The watt density of the area outside the circle (i.e., between the stripes 18 and the circle perimeter will be less, and there will be a significantly lower temperature change. Typically, the power will be applied to the entire target 2 for only a relatively short period, i.e., 30 to 45 seconds at any one time, so that very little heat will migrate from within the heated circle area to the cool area outside.

As will be apparent, the necessary variation in watt density between the areas within and without the circle is obtained by providing that the portion B of a bar within the to-be-heated circle has a greater resistance than do the portions A, C of the bar outside the circle. Since the bars are of substantially constant thickness (typically about 0.0005 inch measured perpendicular to the substrate 12) and resistivity (typically about 200 ohms per square), greater resistivity is obtained by making the center bar portions B are narrower than bar portions A and C.

The overall lengths of the bars and lengths of the center bar portions B are essentially determined by the size and shape of the target area that is to produce the thermal image. Since each wheel target 10 is intended to produce a circular heated area 24 inches in diameter, each bar will have an overall length (between stripes 18) of 24 inches and each bar center portion will form, and thus be equal in length to, a chord of that 24 inch circle.

The widths of the bar portions A, C outside the circular thermal image area, and the widths of the uncoated (i.e., semi-conductor free) spaces between bar portions A, C of adjacent bars are, to some extent, a matter of choice.

To insure good contact between the conductors 20 and the underlying stripes, the widths of the bar portions A, C generally should not be over about ½ inch. The uncoated spaces between should be sufficiently wide to permit good bonding of tape stripe 20, but if the width of the spaces is too great, the heat pattern produced within the circle may be non-uniform.

For purposes of the present invention, the most important factor is the relative resistivity (and hence width) of the different bar portions. To insure that the center bar portions B will in fact produce a circular thermal (infrared image), there must be a significant difference in resistivity (and hence width) between the center portion B and end portions A, C of each bar. To the extent reasonable, it has been found desirable that the width of a bar center portion not exceed about 60% of the width of the bar end portions. However, under some circumstances, (particularly where the center bar portion extends almost the full width of the target), center bar widths up to about 80% of the end bar widths have been found satisfactory.

In the FIG. 5 embodiment, the width of the bar portions A, C of all bars (except bars nos. 1 and 63 at the extreme ends of the semi-conductor pattern) is about ¼ inch (i.e., between 0.25 and 0.30 in.); the A, C portions of bars 1 and 63 are 0.40 inch wide. For all bars, the inter-bar spacing (i.e., the distance between portions A, C of adjacent bars) is about ⅛ inch (i.e., is 0.375 in. less the width of the A, C. portion).

The precise widths of the center portions B of the various bars depend on the above, and also on the desired watt density of the heated circular area (12 watts per squuare foot in the preferred embodiment), the voltage of the power source (source 36 produces 120 volts) and the resistivity of the semi-conductor pattern. The resistivity depends on the particular colloidal graphite ink and dielectric coating (if any) and the thickness at which pattern is printed; the preferred embodiment ink produces a pattern 0.0005 thick (measured perpendicular to the substrate) and has a resistivity (after coating with the dielectric coating) of 200 ohms per square).

The desired width ($W_B$) of the center portion of each bar can be calculated using the following formula:

$$W_B = \frac{2L_B}{\frac{V^2}{DRL_B(W+S)} - 2\left(\frac{L_A+L_C}{W}+2\right) \pm \sqrt{\left[2\left(\frac{L_A+L_C}{W}+2\right) - \frac{V^2}{DRL_B(W+S)}\right]^2 - 4\left(\frac{L_A+L_C}{W}+2\right)^2}}$$

in which (as schematically shown in FIG. 5), $W_B$ is the width of the center portion B of a particular bar, $L_B$ is the length of the center portion B of the bar, $L_A$ and $L_C$ (which are equal since the circle area is centered between stripes) are the lengths, respectively, of end portions A, C of the bar), W is the width of end portions A, C of the bar, S is the uncoated (semi-conductor free) space between the A, C portions of the bar and the A, C portion of the next adjacent bar, R is a resistivity of the printed semi-conductor pattern, V is the voltage applied across the conductors 20 by power source 34, and D is the desired watt density to be produced in the circular heated area.

In each wheel target 10 of the illustrated embodiment, the calculated/desired lengths ($L_B$) and widths ($W_B$) of the center portion of the bars and widths (W) of the end (A, C) portions of the bars are as shown in the following Table I. The length of each end (A, C) portion is ($24-L_B$) 12. In practice, the actual lengths and widths will be slightly different because of inherent inaccuracies and limitations in both screen manufacture and the printing process.

TABLE I

| BARS NOS. | W | $W_B$ | $L_B$ |
|---|---|---|---|
| 1, 63 | .40 | .367 | 5.949 |
| 2, 62 | .25 | .071 | 8.35 |
| 3, 61 | .25 | .133 | 10.144 |
| 4, 60 | .25 | .220 | 11.618 |
| 5, 59 | .26 | .197 | 12.881 |
| 6, 58 | .26 | .215 | 13.991 |
| 7, 57 | .26 | .226 | 14.98 |
| 8, 56 | .27 | .219 | 15.874 |
| 9, 55 | .27 | .225 | 16.685 |
| 10, 54 | .27 | .230 | 17.428 |
| 11, 53 | .27 | .233 | 18.108 |
| 12, 52 | .28 | .231 | 18.733 |
| 13, 51 | .28 | .234 | 19.31 |
| 14, 50 | .28 | .236 | 19.843 |

TABLE I-continued

| BARS NOS. | W | $W_B$ | $L_B$ |
|---|---|---|---|
| 15, 49 | .28 | .238 | 20.332 |
| 16, 48 | .28 | .240 | 20.784 |
| 17, 47 | .29 | .240 | 21.199 |
| 18, 46 | .29 | .241 | 21.581 |
| 19, 45 | .29 | .243 | 21.929 |
| 20, 44 | .29 | .244 | 22.248 |
| 21, 43 | .30 | .244 | 22.537 |
| 22, 42 | .30 | .245 | 22.798 |
| 23, 41 | .30 | .246 | 23.031 |
| 24, 40 | .30 | .247 | 23.237 |
| 25, 39 | .30 | .247 | 23.417 |
| 26, 38 | .30 | .248 | 23.574 |
| 27, 37 | .30 | .248 | 23.704 |
| 28, 36 | .30 | .249 | 23.81 |
| 29, 35 | .30 | .249 | 23.894 |
| 30, 34 | .30 | .249 | 23.953 |
| 31, 33 | .30 | .249 | 23.987 |
| 32 | .25 | .249 | 24 |

From Table I, it will be seen that bar no. 32 (and, in practice, bars nos. 30, 31, 33 and 34 also) extends the full distance between stripes 20. In particular, these bars have no end portions A, C and, since the width of the center portions B is less than ¼ inch, the widths of space(s) adjacent the opposite sides of these bars are slightly more than ⅛ inch.

Referring to FIGS. 1 and 2, it will be seen that target portion 8, which intended to produce a thermal image in the shape of a circular segment, comprises a portion of wheelshaped target portion 10 made by cutting a complete wheel target 10 transversely along a line extending through the uncoated space between a pair of adjacent bars.

Figure 7:
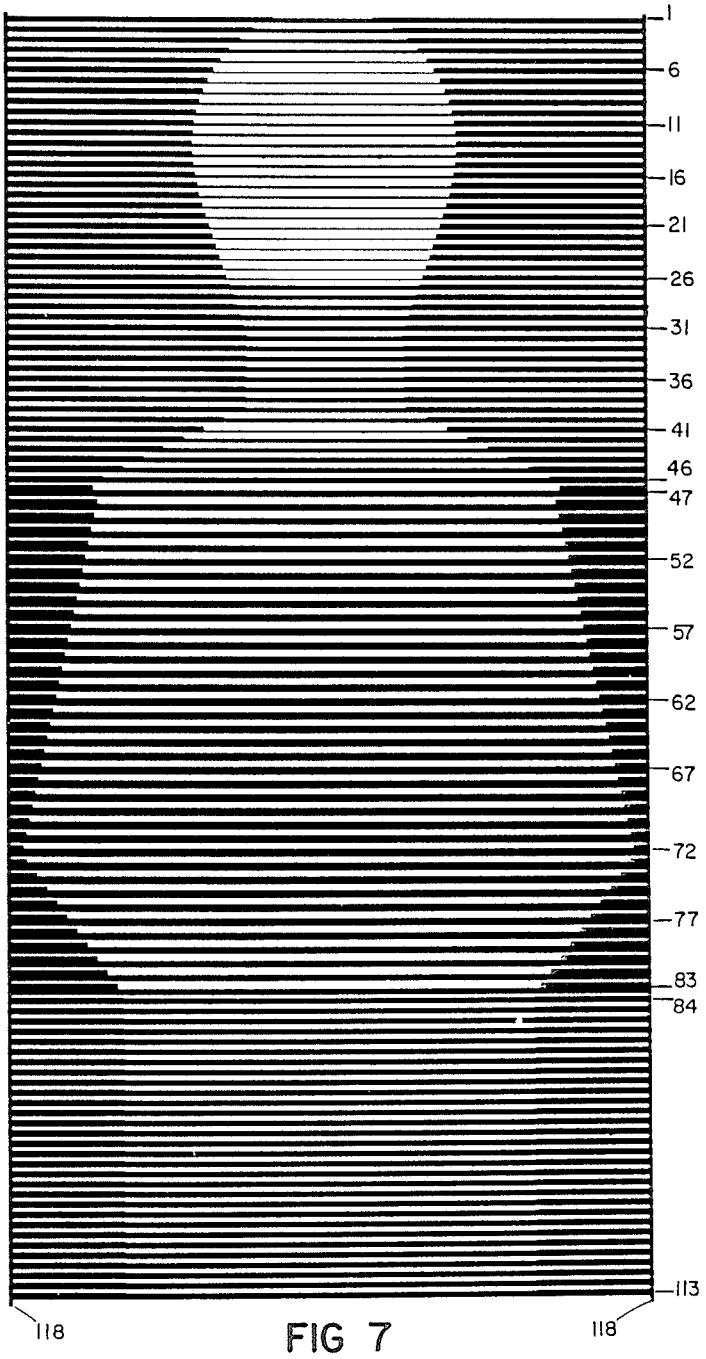
FIG. 7 is a plan view, partially schematic, of an infrared target forming a thermal image similar to that produced by a man.

Reference is now made to FIG. 7 which illustrates a target 100 intended to produce a thermal image representing a human being. Many portions of target 100 are substantially identical to corresponding parts of wheel target 10, and are identified by the same reference numbers with a "1" prefix added.

As shown, target 100 includes a semi-conductor pattern (resistance 200 ohms/square after coating) printed on a plastic substrate 112. The semi-conductor pattern has a pair of longitudinally-extending parallel stripes 118, spaced about 24 inches apart, and there are one hundred thirteen parallel, longitudinally-spaced bars extending perpendicularly between stripes 118. As in target 10, a copper conductor (not shown) is placed on top of each stripe 118 and is there held in place by an overlying plastic tape strip (not shown) that bonds to uncoated areas of the substrate on opposite sides of the respective stripe 118 and conductor.

Each of the transverse bars includes a pair of relatively wide end portions A, C (which extend inwardly from a respective stripe 118) and a relatively thin center portion B. As with wheel target 10, the center portions B produce the desired (in FIG. 7, "man-shaped") thermal image, and the outline of the heated area that produces the image is defined by the junctions between the ends of the center portions B and the adjacent end portions A, C.

It will be seen that the bar width and inter-bar spacing differ in different portions of target 100. The first 46 bars, i.e., those in the upper (head and shoulders) target, have bar end portions A, C about ¼ inch (0.22 or 0.25) wide, and the uncoated space between the end portions A, C of adjacent bars is ⅛ inch wide. Bars nos. 47–83 in the central (torso) portion of the target have end portions A, C and intermediate spaces that are, respectively, 0.45 inch and 1/16 inch wide. The bottom bars (i.e., nos. 84–113) are all identical; each has end portions about ¼ inch (0.26 inch) wide and adjacent bars are about ⅛ apart.

The widths ($W_B$) of the center bar portions B of target 100 are determined using the formula set forth above with respect to wheel target 10. The calculated/-desired lengths ($L_B$) and widths of the center (B) portions, and the widths (W) of the end, (A, C) portions of some of the bars in the target 100 are set forth in the following Table II. The location of the particular bars in the overall target is indicated in FIG. 6. As with target 10, the central lengths and widths will be slightly different.

TABLE II

| BARS NOS. | $W_B$ | $L_B$ | W |
|---|---|---|---|
| 1 | .181 | 3.797 | .22 |
| 6 | .071 | 8.35 | .25 |
| 11 | .12 | 9.844 | .25 |
| 16 | .118 | 9.795 | .25 |
| 21 | .081 | 8.725 | .25 |
| 26 | .07 | 7.442 | .22 |
| 31 | .191 | 6.16 | .23 |
| 36 | .192 | 6 | .23 |
| 41 | .096 | 9.203 | .25 |
| 46 | .226 | 16.875 | .27 |
| 47 | .272 | 17.605 | .45 |
| 52 | .281 | 18.204 | .45 |
| 57 | .296 | 19.341 | .45 |
| 62 | .309 | 20.479 | .45 |
| 67 | .32 | 21.616 | .45 |
| 72 | .33 | 22.755 | .45 |
| 77 | .309 | 20.461 | .45 |
| 83 | .242 | 15.913 | .45 |
| 84–113 | .229 | 15.5 | .26 |

As with target portion 10, widths ($W_B$) of the center bar portions B of man target 100 are such that, when power from a 120 volt source is applied to it, the watt density of the are forming the "man" image is 12 watts per square foot, while the watt density of the areas outside the image, i.e., in the areas covered by bar end portions A, B is significantly less.

For ease in calculation, particularly if a computer is used to perform the calculations, the overall image of a complex shape such as the man-image of target 100 is, to the extent possible, made using regular geometric figures, e.g., portions of circles, trapezoids, triangles, rectangles.

Reference is now made to FIGS. 8 and 9 which illustrate portions of the modified semi-conductor pattern an 18 ¾ inch (diameter) wheel target.

FIG. 8 shows one quadrant 300 (i.e., the right half of the top half), of the complete pattern. The entire semi-conductor pattern includes two parallel stripes 318 (each 5/32 inch wide and the inner edges of which are spaced 20 inches apart) between which extend twenty-eight spaced-apart bars 302. As in targets 10, 100, the semi-conductor pattern is printed on a plastic substrate (not shown) and plastic tape (not shown) holds a copper conductor (not shown) tightly in place on top of each stripe 318.

FIG. 8 shows the right half of bars nos. 1 through 14. The left halves of these bars are mirror images of what is shown; and each bar in bottom half of the target is essentially identical to a corresponding bar of the top half (e.g., bars 1 and 28 are identical to each other and the position of one is a mirror image of that of the other except that, for ease of manufacture, all bars are printed so that their lower edges form straight lines and variations in width are accomplished by removing part of the top of the bar).

Each bar includes a pair of identical end portions, A (not shown) and C (shown in FIG. 8) and a relatively narrow center portion B (one-half of which is shown in FIG. 8). The lengths and widths of the end (A, C) and center (B) portions of the bars are as set forth in the following Table III.

TABLE III

| BARS NOS. | $L_B$ | $W_B$ | $L_A$,$L_C$ | $W_C$,$W_A$ |
|---|---|---|---|---|
| 1, 28 | 7.12 | 0.06 | 6.44 | 0.58 |
| 2, 27 | 8.84 | 0.06 | 5.58 | 0.28 |
| 3, 26 | 10.12 | 0.077 | 4.94 | 0.25 |
| 4, 25 | 11.20 | 0.093 | 4.40 | 0.25 |
| 5, 24 | 12.14 | 0.107 | 3.93 | 0.25 |
| 6, 23 | 12.98 | 0.119 | 3.51 | 0.25 |
| 7, 22 | 13.74 | 0.134 | 3.13 | 0.27 |
| 8, 21 | 14.50 | 0.155 | 2.75 | 0.31 |
| 9, 20 | 15.18 | 0.189 | 2.36 | 0.38 |
| 10, 19 | 16.10 | 0.248 | 1.95 | 0.50 |
| 11, 18 | 17.02 | 0.375 | 1.45 | 0.25 |
| 12, 17 | 17.82 | 0.481 | 1.09 | 0.85 |
| 13, 16 | 18.42 | 0.557 | 0.79 | 1.00 |
| 14, 15 | 18.70 | 0.585 | 0.65 | 1.00 |

Referring now to FIGS. 8 and 9 and to Table III, it will be seen that the width ($W_B$) of end portions A, C of each of bars 11 through 18 is more than one-half inch. To insure proper contact between the portions of stripes 318 at the ends of those bars and the conductors overlying the stripes, a small uncoated (i.e., semi-conductor free) rectangle 310 is provided within, and midway the width of, the end portions A, C of each of these bars. All the rectangles 310 are 1/12 inch wide (measured along stripe 318), and one end of each rectangle abuts the inside edge of a stripe 318. The rectangles in each of bars 11, 12, 13, 16, 17 and 18 are ¼ long, wide (measured perpendicular to stripe 318); those in bars 14 and 15 are 3/16 inch long. To provide for uniform current flow, it will be seen that the areas of bar end portions A, C including rectangles 310 are 1/16 inch wider than are the areas of the end portions abutting bar center portions B.

It also will be seen that, except between bars 10–11 and 18–19 where the inter-bar spacing is 1/16 inch, there is an uncoated spare having a minimum width of ½ inch between each pair of adjacent bars.

Other embodiments will be within the scope of the following claims.

What is claimed is:

1. An electrical heating device for producing a substantially uniform thermal image, comprising:

an electrically insulating substrate;

a pair of spaced-apart, elongated conductors;

a semi-conductor pattern carried on said substrate and including a plurality of spaced-apart heating portions extending between and electrically connected to said conductors;

said heating portions arranged to produce the substantially uniform thermal image at an image producing zone of the substrate between said conductors;

each of a plurality of said heating portions including a first portion positioned in said image producing zone and a second portion positioned outside said image producing zone between said image producing zone and a respective one of said conductors; and said first portions of each of said plurality of heating portions being closely adjacent each other such that the portion of said semi-conductor pattern within said image producing zone of said heating device produces a substantially uniform watt density within said image producing zone when a predetermined voltage is applied across said conductors.

2. The heating device of claim 1 further comprising said heating portions being bars.

3. The heating device of claim 2 further comprising:

said bars being of substantially uniform thickness measured perpendicular to said substrate;

the width of said first portion of said bar measured perpendicular its length being less than the width of said second portion of said bars;

the width of the said first portion of a said bar being approximately equal to:

$$W_B = \frac{2L_B}{\frac{V^2}{DRL_B(W+S)} - 2\left(\frac{L_A+L_C}{W}+2\right) \pm \sqrt{\left[2\left(\frac{L_A+L_C}{W}+2\right) - \frac{V^2}{DRL_B(W+S)}\right]^2 - 4\left(\frac{L_A+L_C}{W}+2\right)^2}}$$

wherein, $W_B$ is the width of portion of the said bar within said image producing zone, $L_B$ is the length of the portion of the said bar within said image producing zone, $L_A+L_C$ is the total length of the portion of the said bar outside said image producing zone and between said conductors, W is the width of the portion of the bar outside said image producing zone and between said conductors, S is the width of the space between the portion of the said bar outside said image producing zone and the next adjacent bar, R is the resistivity of the semi-conductor pattern, $$W_B = \frac{2L_B}{\frac{V^2}{DRL_B(W+S)} - 2\left(\frac{L_A+L_C}{W}+2\right) \pm \sqrt{\left[2\left(\frac{L_A+L_C}{W}+2\right) - \frac{V^2}{DRL_B(W+S)}\right]^2 - 4\left(\frac{L_A+L_C}{W}+2\right)^2}}$$

wherein, $W_B$ is the width of said first portion of the said bar, $L_B$ is the length of said first portion of the said bar, $L_A$ and $L_C$ are the respective lengths of the said second portions of the said bar, W is the width of the said second portions of the said bar, S is the width of the space between the second portions of the said bar and the second portions of the next adjacent bar, R is the resistivity of the semi-conductor pattern, V is said voltage, and D is said watt density.

4. The electrical heating device of claim 2 further comprising:

said conductors being generally parallel;

the portion of said pattern outside said image producing zone being arranged to produce a second and different uniform watt density when said voltage is applied across said conductors; and said first portions of each of said plurality of bars having a first resistance per unit length and said second portions of each of said plurality of bars having a second and different resistance per unit length.

5. The electrical heating device of claim 4 wherein all of said bars are of substantially the same thickness, said thickness being measured perpendicular to said substrate.

6. The heating device of claim 5 wherein said semiconductor pattern comprises a pair of parallel, longitudinally-extending stripes, each of said stripes underlying one of said conductors and being of material having resistivity not greater than that of any of said bars.

7. The heating device of claim 6 wherein the opposite ends of said bars abut said stripes.

8. The heating device of claim 4 further comprising:

the width of the portion of a said bar within said image producing zone being approximately equal to:

V is said voltage, and

D is said first watt density.

9. The heating device of claim 4 wherein the width of the portion of a said bar, measured perpendicular its length, within said image producing zone is less than the width of any portion of said bar located outside said image zone.

10. The electrical heating device of claim 4 wherein both ends of one of said conductors are connected to the positive side of a power source and both ends of the other of said conductors are connected to the negative side of said source.

11. The heating device of claim 4 further comprising portions of said substrate, free of said semi-conductor pattern, between adjacent ones of said bars, the widt h of said semiconductor free portions measured parallel said conductors being not more than about ½ inch (12.7 mm).

12. The electrical heating device of claim 4 further comprising:

said image producing zone being positioned substantially midway between said conductors;

said heating portions further arranged to produce a substantially uniform thermal background at a background producing zone of said heating device;

said background zone outside said image producing zone and intermediate said image zone and one of said conductors.

13. The electrical heating device of claim 4 further comprising:

said conductors extending longitudinally of said substrate;

said image producing zone including a first portion having a first width measured perpendicular said longitudinally extending conductors and a second portion having a second and different width measured perpendicular said longitudinally extending conductors;

the conductor-to-conductor resistance of a said bar of said plurality of bars extending through said first portion of said image producing zone differing from the conductor-to-conductor resistance of a said bar of said plurality of said bars extending through said second portion of said image producing zone;

the portion of a said bar of said plurality of bars within said first portion of said image producing zone having a first resistance per unit length and the portion of a said bar of said plurality of bars within said second portion of said image producing zone having a second and different resistance per unit length, and when a predetermined voltage is applied across said conductors, the watt density produced in said first portion of said image producing zone being uniform and substantially equal to a uniform watt density produced in said second portion of said image producing zone.

14. The electrical device of claim 13 wherein all of said bars are of substantially the same thickness, said thickness being measured perpendicular to said substrate.

15. The electrical device of claim 14 wherein the width of each of said bars, measured perpendicular their length, within said first portion of said imagine producing zone is greater than the width of the said bars within said second portion of said imagine producing zone.

16. The electrical device of claim 15 wherein said first and second portion of said imagine producing zone are positioned generally midway between said conductors, and portions of said semi-conductor pattern outside said imagine producing zone intermediate said first and second portions of said imagine producing zone and said conductors are a uniform watt density different from that produced in said imagine producing zone.

* * * * *

UNITED STATES PATENT OFFICE

CERTIFICATE OF CORRECTION

Patent No. 4,752,672 Dated June 21, 1988

Inventor(s) Frederick G. J. Grise

It is certified that error appears in the above-identified patent and that said Letters Patent are hereby corrected as shown below:

Col. 1, line 14, "295,400" should be --295,000--

Signed and Sealed this

Thirteenth Day of September, 1988

*Attest:*

DONALD J. QUIGG

*Attesting Officer*

*Commissioner of Patents and Trademarks*